US006834624B1

(12) United States Patent
Craft et al.

(10) Patent No.: US 6,834,624 B1
(45) Date of Patent: Dec. 28, 2004

(54) MARINE ENGINE PRESSURE RELIEF VALVE

(75) Inventors: Todd D. Craft, Kenosha, WI (US); James E. Macier, Beach Park, IL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 09/568,838

(22) Filed: May 11, 2000

(51) Int. Cl.[7] ..... F01P 7/14
(52) U.S. Cl. ..... 123/41.08; 123/41.72
(58) Field of Search ..... 123/41.08, 41.72, 123/41.13

(56) References Cited

U.S. PATENT DOCUMENTS

| | | | | | |
|---|---|---|---|---|---|
| 3,918,418 | A | * | 11/1975 | Horn | 123/41.08 |
| 3,939,807 | A | * | 2/1976 | Eichinger | 123/41.72 |
| 4,140,089 | A | * | 2/1979 | Kueny et al. | 123/41.08 |
| 4,621,595 | A | * | 11/1986 | Suzuki | 123/41.72 |
| 4,669,988 | A | * | 6/1987 | Breckenfeld et al. | 123/41.13 |
| 4,674,449 | A | * | 6/1987 | Hundertmark | 123/41.08 |
| 5,330,376 | A | * | 7/1994 | Okumura | 123/41.08 |
| 5,937,802 | A | * | 8/1999 | Bethel et al. | 123/41.08 |
| 5,970,926 | A | * | 10/1999 | Tsunoda et al. | 123/41.08 |
| 6,135,833 | A | * | 10/2000 | Tsunoda | 123/41.08 |

* cited by examiner

*Primary Examiner*—Henry C. Yuen
*Assistant Examiner*—Jason Benton
(74) *Attorney, Agent, or Firm*—BRP Legal Services

(57) ABSTRACT

The present invention, in one aspect, is a pressure responsive valve for a marine engine that facilitates balanced operation of the engine. In an exemplary embodiment, the valve includes a first chamber and a second chamber. Coolant is in flow communication with the valve first chamber, and the engine cylinder head water jackets are in flow communication with the valve second chamber. A flow channel is between the valve first and second chambers, and a plunger is biased to close the flow channel to normally prevent flow from the first chamber to the second chamber. A diaphragm is coupled to the plunger and is responsive to pressure in the first chamber. During operation of the engine at low revolutions per minute (rpm), the pressure of the coolant in the valve first chamber is not sufficient to cause the diaphragm to move the plunger to the open position. As the engine speed increases, the pressure of the coolant also increases. Once the engine speed reaches a sufficiently high rpm so that the coolant pressure exceeds a pre-set pressure, then the coolant pressure in the first chamber causes the plunger to move to the open position. When the plunger is in the open position, coolant flows from the first chamber to the second chamber. As a result, coolant flows through the valve to the cylinder head cooling jackets.

22 Claims, 4 Drawing Sheets

MARINE ENGINE PRESSURE RELIEF VALVE

BACKGROUND OF THE INVENTION

This invention relates generally to marine engines and, more specifically, to cooling engine components during engine operation.

Marine engines typically include a cooling system for cooling at least portions of the engine exhaust system and the engine cylinders. For example, and in a known V-type marine engine, cooling water is supplied into a space between the cylinder banks, sometimes referred to herein as the engine valley. Water flows from the valley and to each cylinder bank. Specifically, a flow path is provided from the valley to each cylinder bank.

With at least some known marine engines, each cylinder bank includes a valve connected in series in a flow path between the cylinder water jackets and cylinder head water jackets.

Generally, the valve is normally closed, and opens when pressure of the cooling water exceeds a pre-set pressure. When the valve opens, cooling water is supplied to the cylinder head jacket. Since a blow off valve is provided for each cylinder bank, the cylinder banks may not necessarily be balanced. For example, if the valve for one cylinder bank is not adjusted exactly the same as the other valve for the other cylinder bank, then the cylinder banks will not be balanced in that one bank will operate hotter than the other cylinder bank. Balanced operation of the cylinder banks facilitates efficient operation of the engine.

BRIEF SUMMARY OF THE INVENTION

The present invention, in one aspect, is a pressure responsive valve for a marine engine that facilitates balanced operation of the engine. In an exemplary embodiment, the valve includes a first chamber and a second chamber. Cooling water is supplied to the valve first chamber, and the cylinder head water jackets of the engine are in flow communication with the valve second chamber. A flow channel is between the valve first and second chambers, and a plunger is biased to close the flow channel to normally prevent flow from the first chamber to the second chamber. A diaphragm is coupled to the plunger.

During operation of the engine at low speeds, i.e., at low revolutions per minute (rpm), coolant flows to and fills the valve first chamber, and the pressure of the coolant in the valve first chamber is not sufficient to overcome the forces that bias the plunger to the closed position. As the engine speed increases, the coolant pressure also increases which results in greater forces acting on the plunger in a direction which causes the plunger to move from the closed position to an open position.

Once the engine speed reaches a sufficiently high rpm so that the coolant pressure exceeds a pre-set pressure, then the coolant pressure in the first chamber overcomes the biasing forces on the plunger, which causes the plunger to move from the closed position to the open position. When the plunger is in the open position, coolant flows from the first chamber to the second chamber. As a result, coolant flows through the valve to the cylinder head cooling jackets.

Since coolant to both cylinder head cooling jackets flows through the pressure responsive valve, the coolant flow to both cylinder head cooling jackets is about the same, which facilitates balanced cooling of each cylinder bank. Such balanced cooling of each cylinder bank facilitates balanced, and efficient operation, of the engine cylinders.

DETAILED DESCRIPTION OF THE INVENTION

The present invention is described herein in the context of an outboard engine. The present invention could, however, be utilized in connection with a stem drive engine as well as with an outboard engine. Further, the present invention is not limited to practice with any one particular engine, and therefore, the following description of an exemplary engine relates to only one exemplary implementation of the present invention.

Figure 1:
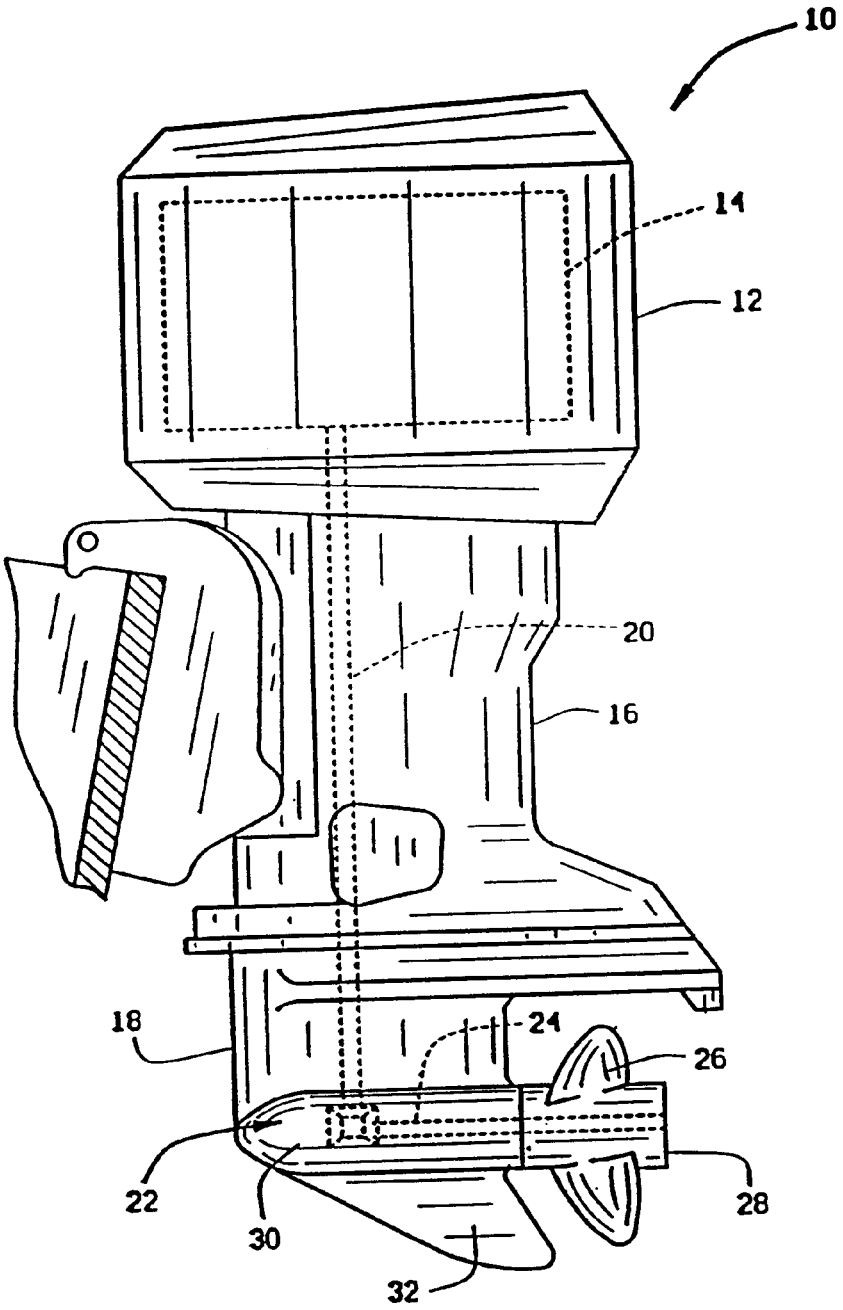
FIG. 1 is a perspective view of an outboard engine.

Referring more particularly to the drawings, FIG. 1 is a perspective view of an outboard engine 10, such as an outboard engine commercially available from Outboard Marine Corporation, Waukegan, Ill. Engine 10 includes a cover 12 which houses a power head 14, an exhaust housing 16, and a lower unit 18. A drive shaft 20 extends from power head 14, through exhaust housing 16, and into lower unit 18.

Lower unit 18 includes a gear case 22 which supports a propeller shaft 24. One end of propeller shaft 24 is engaged to drive shaft 20, and a propeller 26 is engaged to an opposing end of shaft 24. Propeller 26 includes an outer hub 28 through which exhaust gas is discharged. Gear case 22 includes a bullet, or torpedo, 30 and a skeg 32 which depends vertically downwardly from torpedo 30.

Figure 2:
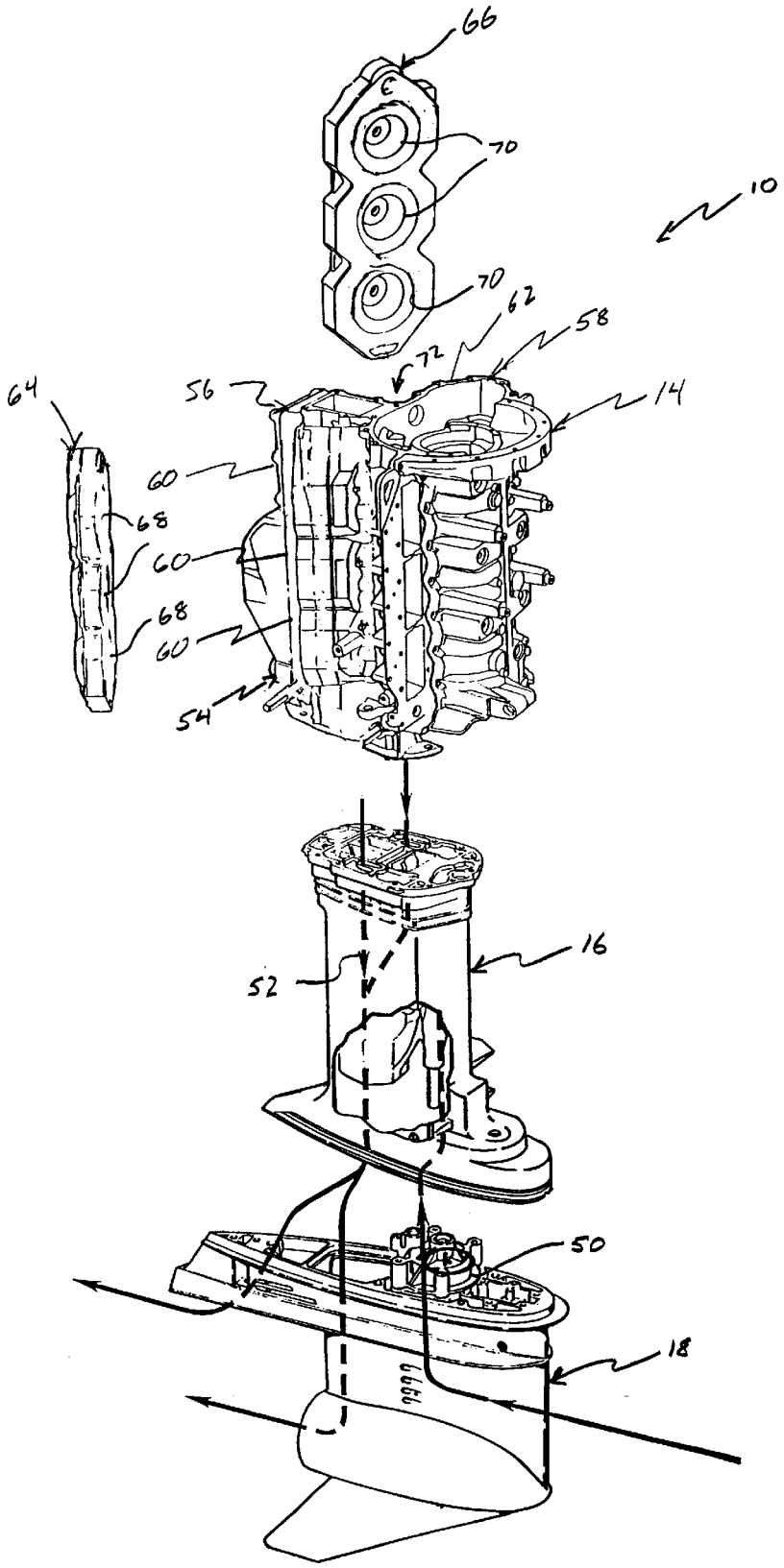
FIG. 2 is an exploded view of a portion of the engine shown in FIG. 1.

FIG. 2 is an exploded view of some components of engine 10. As shown in FIG. 2, power head 14, exhaust housing 16, and lower unit 18 couple together. The arrows in FIG. 2 indicate water flow paths through lower unit 18 and exhaust housing 16 to power head 14. Specifically, a water pump 50 draws water into lower unit 18 and pumps water through exhaust housing 16 into power head 14 to cool components of power head 14. The heated water then flows back through passages in exhaust housing 16 and is discharged from lower unit 18. Passages through which water is returned to the body of water are sometimes referred to herein as dump passages or a dump 52.

Power head 14 includes an engine block 54 having cylinder banks 56 and 58 defining a plurality of cylinders 60 and 62. Cylinder heads 64 and 66 engage to block 54. Each cylinder head 64 and 66 includes a series of combustion chamber recesses 68 and 70 respectively communicating with cylinders 60 and 62. Cylinder head cooling jackets formed in cylinder heads 64 and 66 provide cooling during engine operations as described below. A gasket (not shown) can be located between a cylinder head surface and a surface of the associated cylinder bank. Power head 14 is a V-type in that power head 14 includes two cylinder banks 56 and 58 and a valley 72 between each cylinder bank 56 and 58.

Again, the engine illustrated in FIGS. 1 and 2 is exemplary only, and the pressure relief valve described below can be used in connection with the above described engine as well as in connection with other engines. For example, the engine described above is a six cylinder V-type engine, and the relief valve can be used in connection with an engine having fewer or more cylinders. In addition, the relief valve can be used with an in-line engine as well.

Figure 3:
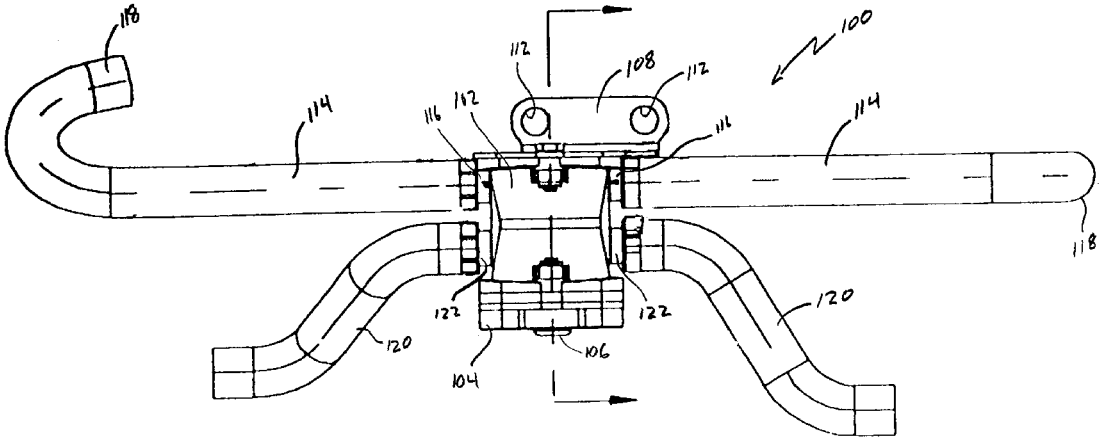
FIG. 3 is a front view of a blow-off valve in accordance with one embodiment of the present invention.
Figure 4:
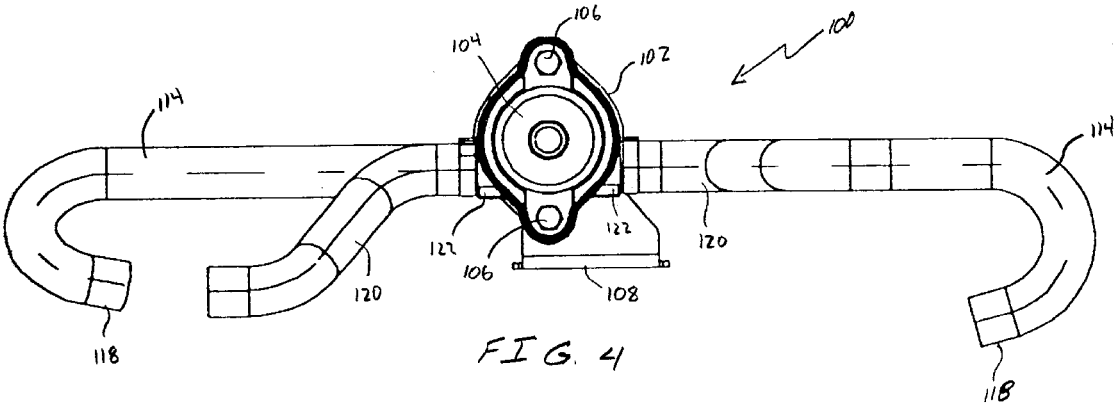
FIG. 4 is a top view of the valve shown in FIG. 3.

FIG. 3 is a front view of a blow-off valve 100 in accordance with one embodiment of the present invention, and FIG. 4 is a bottom view of valve 100. Valve 100 can be coupled, for example, to receive coolant from the cylinder bore cooling jackets, and to output coolant to the cylinder head cooling jackets of engine 10.

Referring to both FIGS. 3 and 4, valve 100 includes a housing 102 having a cover 104 secured to one end thereof by screws 106 and a bracket 108 secured to the other end thereof by screws 110. Bracket 108 includes openings 112 to enable mounting valve 100 to an engine, such as to an engine block.

Coolant is supplied to valve 100 via hoses 114. Specifically, valve 100 includes inlet ports 116, and hoses 114 coupled to inlet ports 116 supply coolant to valve 100. Coolant, e.g., water, can be supplied to hoses 114 via, for example, cylinder bore cooling jackets. For example, ends 118 of hoses 114 opposite valve 100 can be coupled to outlet ports of the cylinder bore cooling jackets so that coolant flows through hoses 114 to valve 100.

Coolant flows from valve 100 via hoses 120. Specifically, valve 100 includes outlet ports 122, and hoses 120 coupled to outlet ports 122 supply coolant from valve 100 to, for example, cylinder head cooling jackets.

Figure 5:
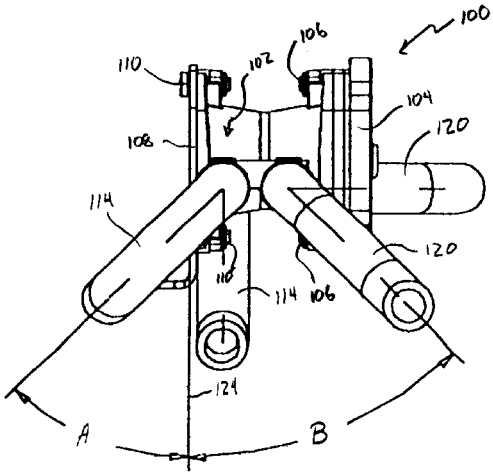
FIG. 5 is a left side view of the valve shown in FIG. 3.
Figure 6:
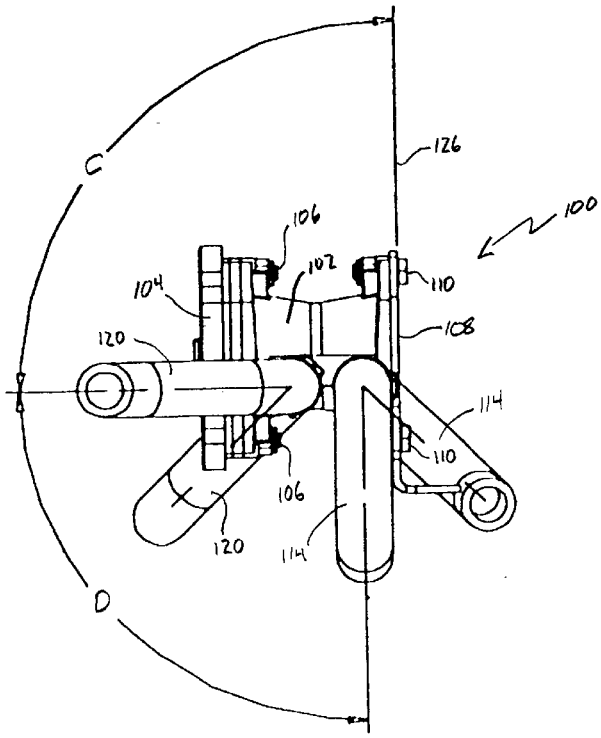
FIG. 6 is a right side view of the valve shown in FIG. 3.

FIG. 5 is a left side view of valve 100, and FIG. 6 is a right side view of valve 100. As shown in FIG. 5, an angle A between a reference line 124 and a centerline of hose 114 is about 45° and an angle B between reference line 124 and a centerline of hose 120 is about 45°. As shown in FIG. 6, an angle C between reference line 126 and a centerline of hose 126 is about 90°, and an angle between centerline of hose 120 and a centerline of hose 114 is about 90°.

Figure 7:
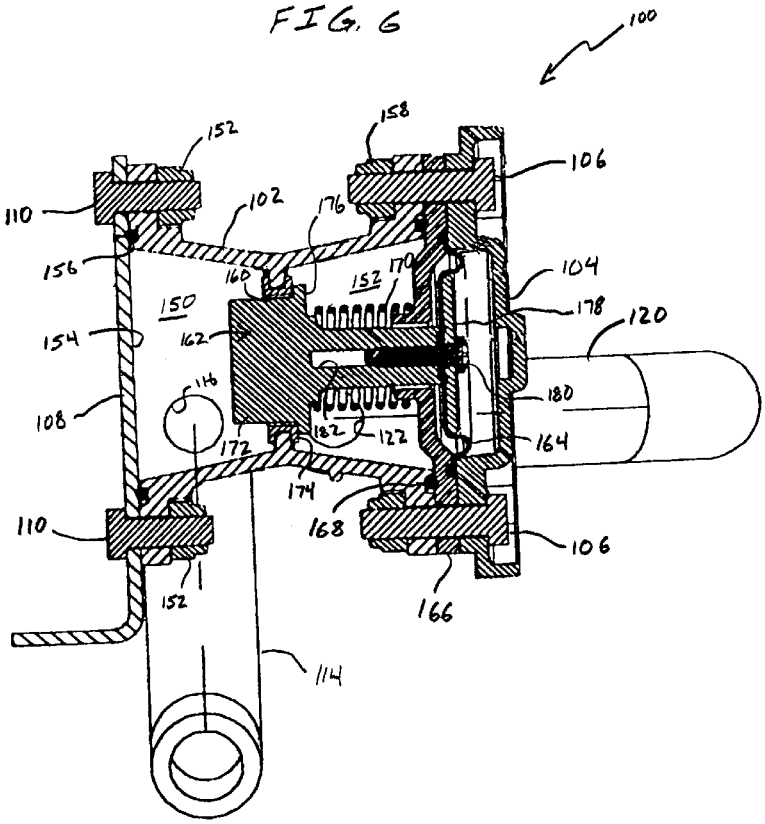
FIG. 7 is a cross-sectional view of the valve shown in FIG. 3 through line 7—7.

FIG. 7 is a cross-sectional view of valve 100 through line 7—7 shown in FIG. 3. Valve 100 includes a first chamber 150 and a second chamber 152. Bracket 108 is secured to housing 102 by screws 110 and nuts 152 and forms a wall 154 of first chamber 150. An o-ring 156 forms a seal between bracket 108 and housing 102. Cover 104 is secured to housing 102 by screws 106 and nuts 158.

First chamber 150 receives coolant via inlet ports 116, and second chamber 152 is in flow communication with cylinder head cooling jackets via outlet ports 122. A flow channel 160 is between first and second chambers 150 and 152, and a plunger 162 is biased to close flow channel 160 to normally prevent flow from first chamber 150 to second chamber 152. A diaphragm 164 is supported by a plate 166, and is coupled to plunger 162. An o-ring 168 forms a seal between plate 166 and housing 102.

Plunger 162 is biased to a closed position by a spring 170 that extends between plate 166 and a head 172 of plunger 162. A seal 174 at an outer perimeter of flow channel 160 is positioned so that a plunger head flange 176 seats on seal 174 when plunger 162 is in the closed position. A support 178 is secured to diaphragm 164, and a threaded screw 180 extends through support 178, diaphragm 164 and into threaded engagement with plunger 162. Plunger 162 includes a bore 182, and threaded screw 180 extends into bore 182.

During engine operation, coolant is supplied to first chamber 150 via hoses 114. At low rpm, plunger 162 prevents flow of coolant from first chamber 150 to second chamber 152. As engine speed increases, the pressure of the coolant also increases. Once the coolant pressure is sufficient to overcome the biasing forces of spring 170, plunger 162 moves away from seal 174 allowing flow of the coolant from first chamber 150 to second chamber 152. Diaphragm 164 allows such movement of plunger 162 yet retains a pressure seal in second chamber 152. Once the engine rpm falls below the point at which the pressure of the coolant is above the pre-set pressure, then spring 170 causes plunger 162 to return to the closed position shown in FIG. 7.

The pressure at which plunger 162 moves to the open position is selectable and pre-set based on the biasing force of spring 170, which may vary from engine to engine depending upon the engine speed at which coolant flow is needed to the cylinder head cooling jackets. The pre-set pressure can be determined emprically on an engine specific basis.

Since coolant to both cylinder head cooling jackets flows through the pressure responsive valve, the coolant flow through both cylinder head cooling jackets is about the same, which facilitates balanced cooling of the cylinder banks. Such balanced cooling of the cylinder banks facilitates balanced, and efficient operation, of the engine cylinders.

While the invention has been described in terms of various specific embodiments, those skilled in the art will recognize that the invention can be practiced with modification within the spirit and scope of the claims.

What is claimed is:

1. A marine engine, comprising:

an engine block comprising at least one cylinder bank, said cylinder bank comprising at least one cylinder bore;

a cylinder head, cooling jacket secured to said engine block;

a valve comprising a first chamber and a second chamber, said first chamber configured to receive coolant, said second chamber in flow communication with said cylinder head cooling jacket, a flow channel between said first and second chambers, a plunger biased to close said flow channel to normally prevent flow from said first chamber to said second chamber, a diaphragm coupled to said plunger so that once pressure in said first chamber increases above a pre-set pressure, said plunger moves to an open position and coolant flows from said first chamber to said second chamber; and a plurality of hoses for coupling said valve to said marine engine.

2. A marine engine in accordance with claim 1 further comprising a cylinder bore cooling jacket in flow communication with said first chamber to supply coolant thereto.

3. A marine engine in accordance claim 1 wherein said plunger is biased to a closed position by a spring.

4. A marine engine in accordance with claim 1 further comprising a seal at an outer perimeter of said flow channel, said seal positioned so that said plunger seats on said seal when said plunger is in said closed position.

5. A marine engine in accordance with claim 1 further comprising a support secured to said diaphragm, and a threaded screw extending through said support, said diaphragm and into threaded engagement with said plunger.

6. A marine engine in accordance with claim 5 wherein said plunger comprises a bore, and wherein said threaded screw extends into said bore.

7. A marine engine in accordance with claim 1 wherein said valve further comprises a housing, a bracket secured to said housing and forming a wall of said first chamber.

8. A marine engine in accordance with claim 7 further comprising a cover secured to said housing.

9. A marine engine, comprising:

an engine block comprising a first cylinder bank and a second cylinder bank, said first and second cylinder banks in a V-configuration, a valley between said cylinder banks, each cylinder bank comprising at least one cylinder bore;

a first cylinder bore water jacket in flow communication with said valley and at least a portion of said block forming each said cylinder bore in said first cylinder bank;

a second cylinder bore water jacket in flow communication with said valley and at least a portion of said block forming each said cylinder bore in said second cylinder bank;

a first cylinder head water jacket;

a second cylinder head water jacket;

a valve comprising a first chamber and a second chamber, said first and second cylinder bore water jackets in flow communication with said first chamber, said first and second cylinder head water jackets in flow communication with said second chamber, a flow channel between said first and second chambers, a plunger biased to close said flow channel to normally prevent flow from said first chamber to said second chamber, a diaphragm coupled to said plunger so that when pressure in said first chamber exceeds a pre-set pressure, said plunger moves to an. open position and coolant flows from said first chamber to said second chamber; and a plurality of hoses for coupling said valve to said marine engine.

10. A marine engine in accordance with claim 9 wherein said plunger is biased to a closed position by a spring.

11. A marine engine in accordance with claim 9 further comprising a seal at an outer perimeter of said flow channel, said seal positioned so that said plunger seats on said seal when said plunger is in said closed position.

12. A marine engine in accordance with claim 9 further comprising a support secured to said diaphragm, and a threaded screw extending through said support, said diaphragm and into threaded engagement with said plunger.

13. A marine engine in accordance with claim 12 wherein said plunger comprises a bore, and wherein said threaded screw extends into said bore.

14. A marine engine in accordance with claim 9 wherein said valve further comprises a housing, a bracket secured to said housing and forming a wall of said first chamber.

15. A marine engine in accordance with claim 14 further comprising a cover secured to said housing.

16. A kit comprising:

a valve;

said valve comprising a first chamber and a second chamber, a flow channel between said first and second chambers, a plunger biased to close said flow channel to normally prevent flow from said first chamber to said second chamber, a diaphragm coupled to said plunger, said plunger responsive to pressure in said first chamber so that once pressure in said first chamber increases above a pre-set pressure, said plunger moves to an open position to allow flow from said first chamber to said second chamber; and a plurality of hoses for coupling said valve to a marine engine.

17. A kit in accordance claim 16 wherein said plunger is biased to a closed position by a spring.

18. A kit in accordance with claim 16 further comprising a seal at an outer perimeter of said flow channel, said seal positioned so that said plunger seats on said seal when said plunger is in said closed position.

19. A kit in accordance with claim 16 further comprising a support secured to said diaphragm, and a threaded screw extending through said support, said diaphragm and into threaded engagement with said plunger.

20. A kit in accordance with claim 16 wherein said plunger comprises a bore, and wherein said threaded screw extends into said bore.

21. A kit in accordance with claim 16 wherein said valve further comprises a housing, a bracket secured to said housing and forming a wall of said first chamber.

22. A kit in accordance with claim 21 further comprising a cover secured to said housing.

* * * * *

UNITED STATES PATENT AND TRADEMARK OFFICE

CERTIFICATE OF CORRECTION

PATENT NO. : 6,834,624 B1
DATED : December 28, 2004
INVENTOR(S) : Todd Craft and James Macier It is certified that error appears in the above-identified patent and that said Letters Patent is hereby corrected as shown below:

Column 6,
Line 35, claim reference numeral "16" should read -- 19 --.

Signed and Sealed this

Twenty-first Day of June, 2005

JON W. DUDAS
*Director of the United States Patent and Trademark Office*